US011661747B2

(12) United States Patent
Brochu

(10) Patent No.: US 11,661,747 B2
(45) Date of Patent: May 30, 2023

(54) GUTTER GUARD FOR GUTTER AND GUTTER ASSEMBLY INCLUDING SAME

(71) Applicant: Tommy Brochu, Levis (CA)

(72) Inventor: Tommy Brochu, Levis (CA)

( * ) Notice: Subject to any disclaimer, the term of this patent is extended or adjusted under 35 U.S.C. 154(b) by 0 days.

(21) Appl. No.: 17/007,508

(22) Filed: Aug. 31, 2020

(65) Prior Publication Data

US 2021/0062512 A1 Mar. 4, 2021

Related U.S. Application Data

(60) Provisional application No. 62/893,980, filed on Aug. 30, 2019.

(51) Int. Cl.
*E04D 13/068* (2006.01)

(52) U.S. Cl.
CPC ..... *E04D 13/0685* (2013.01)

(58) Field of Classification Search
CPC ..... E04D 2013/045; E04D 2013/0866; E04D 2013/086; E04D 13/0445; E04D 13/0459; E04D 13/064; E04D 13/076; E04D 13/0765
USPC ..... 52/11, 12
See application file for complete search history.

(56) References Cited

U.S. PATENT DOCUMENTS

D90,272 S 7/1933 White
2,277,443 A 3/1942 Livingstone
3,042,742 A 7/1962 Foster
3,295,803 A 1/1967 Blayden
3,436,878 A 4/1969 Singer
4,241,548 A 12/1980 Rowe
4,808,234 A 2/1989 McKay et al.
4,820,407 A 4/1989 Lilie
5,271,192 A * 12/1993 Nothum, Sr. ..... E04D 13/076 248/48.2
5,406,754 A 4/1995 Cosby
5,619,825 A 4/1997 Leroney et al.
5,744,218 A 4/1998 Barnes
(Continued)

FOREIGN PATENT DOCUMENTS

CA 166698 12/1915
CA 169577 5/1916
(Continued)

*Primary Examiner* — Jessica L Laux
(74) *Attorney, Agent, or Firm* — David J. Kulik

(57) ABSTRACT

There is provided a gutter assembly comprising: a gutter and a gutter guard. The gutter has a front portion including an outwardly inclined segment and a front inverted hook member defining an inward recess. The gutter guard is engageable with the gutter to cover an opening thereof. The gutter guard includes a front portion operatively engageable with the front portion of the gutter. The front portion comprises a recess-engaging portion and an inclined segment abutting portion, the recess-engaging portion being insertable in the inward recess and abuttable against the front inverted hook member with the inclined segment abutting portion abutting against the outwardly inclined segment when the recess-engaging portion is inserted in the inward recess with a rear portion of the gutter guard extends spaced-apart from a bottom wall of the gutter even if unattached to a rear portion of the gutter. There is also provided a method for mounting a gutter assembly to a supporting surface.

22 Claims, 3 Drawing Sheets

(56) References Cited

U.S. PATENT DOCUMENTS

| | | | | |
|---|---|---|---|---|
| 5,906,287 | A | 5/1999 | Kohnen | |
| 6,134,843 | A | 10/2000 | Tregear | |
| D460,197 | S | 7/2002 | Stringer | |
| 6,427,388 | B1 | 8/2002 | Brochu | |
| D468,446 | S | 1/2003 | Sender et al. | |
| 6,701,674 | B1 | 3/2004 | Albracht | |
| 6,786,008 | B2 * | 9/2004 | Brochu | E04D 13/076 248/48.1 |
| 6,826,872 | B2 * | 12/2004 | Brochu | E04D 13/076 52/11 |
| D523,538 | S | 6/2006 | Brochu | |
| D523,969 | S | 6/2006 | Abruzese et al. | |
| D551,740 | S | 9/2007 | Riley | |
| D558,309 | S | 12/2007 | Gregg | |
| D569,011 | S | 5/2008 | Brochu | |
| 7,614,185 | B2 * | 11/2009 | Brochu | E04D 13/076 52/11 |
| 7,624,541 | B2 | 12/2009 | Gentry | |
| 7,658,036 | B2 | 2/2010 | Banks | |
| 7,765,743 | B2 | 8/2010 | Guilford | |
| 7,908,797 | B2 | 3/2011 | Graves | |
| 7,913,458 | B2 | 3/2011 | Higginbotham | |
| 8,037,641 | B2 | 10/2011 | Gerig | |
| D651,292 | S | 12/2011 | Geers | |
| 8,191,315 | B1 * | 6/2012 | Brochu | E04D 13/076 52/12 |
| 8,322,082 | B2 * | 12/2012 | Neumann | E04D 13/076 52/12 |
| 8,347,557 | B2 | 1/2013 | Minor, Sr. et al. | |
| 8,375,644 | B2 | 2/2013 | Robins | |
| D677,405 | S | 3/2013 | Landis | |
| 8,434,269 | B1 | 5/2013 | Brochu | |
| 8,479,454 | B2 | 7/2013 | Lenney et al. | |
| 8,635,811 | B2 | 1/2014 | Horton | |
| D719,648 | S | 12/2014 | Moody et al. | |
| D721,826 | S | 1/2015 | Ryan | |
| D723,671 | S | 3/2015 | Brochu | |
| 8,997,403 | B1 * | 4/2015 | Steinberg | F16M 13/02 52/12 |
| 8,997,408 | B2 * | 4/2015 | Borra | E04G 21/3276 52/90.1 |
| 9,010,029 | B2 | 4/2015 | Higginbotham | |
| 9,010,030 | B2 | 4/2015 | Davis | |
| D736,900 | S | 8/2015 | Frelier | |
| 9,127,463 | B1 | 9/2015 | Feldhaus | |
| 9,163,406 | B1 * | 10/2015 | Ealer, Sr. | E04D 13/076 |
| D742,541 | S | 11/2015 | Ryan | |
| D770,603 | S | 11/2016 | Fryml | |
| D782,624 | S | 3/2017 | Haendel | |
| D792,985 | S | 7/2017 | Jones | |
| D796,067 | S | 8/2017 | Landis et al. | |
| 10,538,921 | B2 * | 1/2020 | Brochu | E04D 13/076 |
| 10,604,936 | B2 * | 3/2020 | Brochu | E04D 13/076 |
| 2003/0110712 | A1 | 6/2003 | Brochu | |
| 2004/0060244 | A1 | 4/2004 | Brochu | |
| 2004/0118052 | A1 | 6/2004 | Brochu | |
| 2004/0182014 | A1 | 9/2004 | Brochu | |
| 2004/0244302 | A1 | 12/2004 | Neumann | |
| 2005/0028452 | A1 | 2/2005 | Brochu | |
| 2005/0115160 | A1 | 6/2005 | Brochu | |
| 2005/0193642 | A1 | 9/2005 | Brochu et al. | |
| 2005/0193671 | A1 | 9/2005 | Brochu et al. | |
| 2005/0223657 | A1 | 10/2005 | Brochu et al. | |
| 2005/0279036 | A1 | 12/2005 | Brochu | |
| 2006/0037254 | A1 | 2/2006 | Brochu | |
| 2006/0037255 | A1 | 2/2006 | Brochu | |
| 2006/0123710 | A1 | 6/2006 | Lenney et al. | |
| 2006/0283097 | A1 | 12/2006 | Gregg | |
| 2007/0167130 | A1 | 7/2007 | Brochu | |
| 2007/0169423 | A1 | 7/2007 | Brochu | |
| 2008/0010906 | A1 | 1/2008 | Brochu | |
| 2008/0289263 | A1 | 1/2008 | Brochu | |
| 2008/0163561 | A1 | 7/2008 | Lenney | |
| 2008/0190039 | A1 | 8/2008 | Brochu | |
| 2008/0190070 | A1 | 8/2008 | Duncan et al. | |
| 2009/0013612 | A1 | 1/2009 | Brochu | |
| 2009/0056234 | A1 | 3/2009 | Brochu | |
| 2009/0108144 | A1 * | 4/2009 | Brochu | E04D 13/076 248/48.1 |
| 2010/0287846 | A1 | 11/2010 | Lenney | |
| 2011/0056145 | A1 | 3/2011 | Lenney | |
| 2011/0067317 | A1 | 3/2011 | Hedrick | |
| 2011/0067318 | A1 | 3/2011 | Lenney et al. | |
| 2011/0138698 | A1 | 6/2011 | Neumann | |
| 2012/0151849 | A1 | 6/2012 | Brochu | |
| 2013/0091780 | A1 | 4/2013 | Robins | |
| 2014/0069028 | A1 | 3/2014 | Lenney | |
| 2014/0215929 | A1 | 8/2014 | Lenney | |
| 2015/0020462 | A1 | 1/2015 | Iannelli | |
| 2015/0040488 | A1 | 2/2015 | Lenney | |
| 2015/0143756 | A1 | 5/2015 | Higginbotham | |
| 2015/0225959 | A1 | 8/2015 | Lenney | |
| 2015/0330085 | A1 | 11/2015 | Iannelli | |
| 2016/0060870 | A1 | 3/2016 | Martin | |
| 2016/0369512 | A1 | 12/2016 | Lenney | |
| 2018/0030733 | A1 | 2/2018 | Brochu | |
| 2019/0136536 | A1 | 5/2019 | Brochu | |

FOREIGN PATENT DOCUMENTS

| | | | |
|---|---|---|---|
| CA | 175672 | | 3/1917 |
| CA | 2305159 | | 10/2001 |
| CA | 2305159 | A1 | 10/2001 |
| CA | 2451186 | | 1/2003 |
| CA | 2405756 | | 3/2004 |
| CA | 2458005 | | 8/2005 |
| CA | 2458006 | | 8/2005 |
| CA | 2460429 | | 9/2005 |
| CA | 2541186 | | 7/2007 |
| CA | 2593808 | | 1/2009 |
| CA | 2608530 | | 4/2009 |
| CA | 2747704 | | 7/2009 |
| CA | 2723499 | A1 | 3/2011 |
| CA | 2727844 | | 7/2012 |
| CA | 2747513 | | 1/2013 |
| CA | 2783834 | | 8/2013 |
| CA | 2775864 | A1 | 11/2013 |
| CA | 2933239 | | 7/2015 |
| CA | 2863023 | | 3/2016 |
| CA | 2907280 | | 2/2017 |
| CA | 2955268 | | 7/2017 |
| CA | 2919709 | | 8/2017 |
| CA | 2963962 | | 10/2017 |
| CA | 2931540 | | 11/2017 |
| CA | 2985004 | | 5/2018 |
| CA | 3016527 | | 3/2019 |
| CA | 3023339 | | 5/2019 |
| EP | 1449980 | A1 | 8/2004 |
| EP | 1627974 | A2 | 2/2006 |
| EP | 2159342 | | 3/2010 |
| EP | 2177685 | A1 | 4/2010 |
| EP | 2251500 | | 11/2010 |
| GB | 2481033 | | 12/2011 |
| GB | 2493284 | | 1/2013 |
| GB | 2493284 | A | 1/2013 |
| GB | 2841033 | | 1/2013 |
| WO | 2007100320 | | 9/2007 |
| WO | 2008134845 | A1 | 11/2008 |
| WO | 2009150174 | | 12/2009 |

* cited by examiner

GUTTER GUARD FOR GUTTER AND GUTTER ASSEMBLY INCLUDING SAME

CROSS-REFERENCE TO RELATED APPLICATIONS

This application claims priority under 35 U.S.C. § 119(e) of U.S. provisional patent application 62/893,980 filed on Aug. 30, 2019, the specification of which is hereby incorporated by reference.

TECHNICAL FIELD

The technical field generally relates to a gutter guard and gutter assembly including same.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board.

Leaves and debris may accumulate within the trough of the gutter, which can prevent the rainwater from flowing through the trough. Gutter guards are used to protect the gutter by preventing leaves and debris from entering the trough of the gutter while still permitting rainwater to enter the trough.

There is always a need for a gutter guard and a gutter assembly that can be easily mounted to a supporting structure such as an outdoor building wall.

SUMMARY

According to one aspect, there is provided a gutter assembly comprising: a gutter having a front portion, a rear portion, a bottom wall extending between the front portion and the rear portion, and an opening defined between the front and the rear portions adjacent to upper edges thereof, the front portion comprising an outwardly inclined segment and a front inverted hook member defining an inward recess; and a gutter guard engageable with the gutter to cover the opening, the gutter guard including a front portion operatively engageable with the front portion of the gutter, a rear portion, and a central portion extending between the front portion and the rear portion, the front portion comprising a recess-engaging portion and an inclined segment abutting portion, the recess-engaging portion being insertable in the inward recess and abuttable against the front inverted hook member with the inclined segment abutting portion abutting against the outwardly inclined segment of the gutter when the recess-engaging portion is inserted in the inward recess and the rear portion of the gutter guard extending spaced-apart from the bottom wall of the gutter even if unattached to the rear portion of the gutter.

According to another aspect, there is provided a gutter assembly comprising: a gutter having a front portion, a rear portion, a bottom wall extending between the front portion and the rear portion, and an opening defined between the front and the rear portions adjacent to upper edges thereof, the front portion comprising an outwardly inclined segment, an upright segment, an upper rim, and a downwardly forwardly-extending flange with the upright segment, the upper rim, and the downwardly forwardly-extending flange defining an inward recess; and a gutter guard engageable with the gutter to cover the opening, the gutter guard including a front portion operatively engageable with the front portion of the gutter, a rear portion, and a central portion extending between the front portion and the rear portion, the front portion comprising a recess-engaging portion and an inclined segment abutting portion, the recess-engaging portion being insertable in the inward recess and abuttable against at least one of the upper rim and the downwardly forwardly-extending flange with the inclined segment abutting portion abutting against the outwardly inclined segment of the gutter when the recess-engaging portion is inserted in the inward recess and the rear portion of the gutter guard extending spaced-apart from the bottom wall of the gutter even if unattached to the rear portion of the gutter.

According to a further aspect, there is provided a method for mounting a gutter assembly to a supporting surface. The method comprises: providing a gutter comprising a front portion, a rear portion, a bottom wall extending between the front portion and the rear portion, and an opening defined between the front and the rear portions adjacent to upper edges thereof, the front portion comprising an outwardly inclined segment and a front inverted hook member defining an inward recess; providing a gutter guard comprising a rear portion, and a central portion extending between the front portion and the rear portion, the front portion comprising a recess-engaging portion and an inclined segment abutting portion; engaging the recess-engaging portion in the inward recess to abut against the front inverted hook member with the inclined segment abutting portion abutting against the outwardly inclined segment of the gutter and the rear portion of the gutter guard extending spaced-apart from the bottom wall of the gutter; inserting a lower segment of a drip edge between the rear wall of the gutter guard and the rear portion of the gutter; and securing an assembly including the rear wall of the gutter guard, the rear portion of the gutter, the lower segment of the drip edge together by inserting a plurality of longitudinally spaced-apart mechanical fasteners therein and into a supporting surface.

According to another general aspect, there is provided a gutter assembly comprising: a gutter and a gutter guard engageable with the gutter. The gutter has a front portion, a rear portion, a bottom wall extending between the front portion and the rear portion, and an opening defined between the front and the rear portions adjacent to upper edges thereof. The front portion comprises an outwardly inclined segment and a front inverted hook member defining an inward recess. When engaged with the gutter, the gutter guard covers the opening. The gutter guard includes a front portion operatively engageable with the front portion of the gutter, a rear portion, and a central portion extending between the front portion and the rear portion. The front portion comprises a recess-engaging portion and an inclined segment abutting portion. The recess-engaging portion is insertable in the inward recess and abuttable against the front inverted hook member with the inclined segment abutting portion abutting against the outwardly inclined segment of the gutter when the recess-engaging portion is inserted in the inward recess. The rear portion of the gutter guard extends spaced-apart from the bottom wall of the gutter even if unattached to the rear portion of the gutter.

In an embodiment, the central portion of the gutter guard extends at an angle ranging between about 0 degree and 45 degrees when the recess-engaging portion is inserted in the inward recess and the rear portion of the gutter guard is unattached to the rear portion of the gutter.

In an embodiment, the gutter guard is made of an aluminium-based sheet having a thickness ranging between about 0.3 mm and about 0.81 mm.

In an embodiment, the recess-engaging portion of the gutter guard extends next to a front end of the central portion of the gutter guard and the inclined segment abutting portion of the gutter guard extends between the recess-engaging portion of the gutter guard and a front free edge of the gutter guard.

In an embodiment, the inclined segment abutting portion of the gutter guard extends next to a front end of the central portion with the recess-engaging portion of the gutter guard extends between the inclined segment abutting portion and a front free edge of the gutter guard.

In an embodiment, the recess-engaging portion of the gutter guard comprises a plurality of folds to define a plurality of segments forming an upwardly and rearwardly extending hook having a tip abutting against an inner surface of the front inverted hook member when inserted in the inward recess. The front portion of the gutter can comprise successively, from a front edge of the bottom wall, the outwardly inclined segment, an upright substantial vertical segment, an upper rim, extending essentially horizontally, and a downwardly forwardly-extending flange, with the upper rim and the downwardly forwardly-extending flange forming the front inverted hook member. An angle ranging between about 35 degrees and about 80 degrees can be defined between the upper rim and the downwardly forwardly-extending flange. An angle ranging between about 110 degrees and about 170 degrees can be defined between the upright substantial vertical segment and the outwardly inclined segment. The tip can abut against at least one of the upper rim and the downwardly forwardly-extending flange when inserted in the inward recess.

In an embodiment, the rear portion of the gutter guard comprises a rear wall.

In an embodiment, the inclined segment abutting portion of the gutter guard abuts against the outwardly inclined segment of the gutter along an entire length of the inclined segment abutting portion of the gutter guard.

In an embodiment, the central portion of the gutter guard comprises a plurality of through holes formed therein.

In an embodiment, the outwardly inclined segment of the gutter defines an angle ranging between about 10 degrees and about 85 degrees with a horizontal axis.

According to still another general aspect, there is provided a gutter assembly comprising: a gutter and a gutter guard engageable with the gutter. The gutter has a front portion, a rear portion, a bottom wall extending between the front portion and the rear portion, and an opening defined between the front and the rear portions adjacent to upper edges thereof. The front portion comprises an outwardly inclined segment, an upright segment, an upper rim, and a downwardly forwardly-extending flange with the upright segment, the upper rim, and the downwardly forwardly-extending flange defining an inward recess. When engaged with the gutter, the gutter guard covers the opening. The gutter guard includes a front portion operatively engageable with the front portion of the gutter, a rear portion, and a central portion extending between the front portion and the rear portion. The front portion comprises a recess-engaging portion and an inclined segment abutting portion, the recess-engaging portion being insertable in the inward recess and abuttable against at least one of the upper rim and the downwardly forwardly-extending flange with the inclined segment abutting portion abutting against the outwardly inclined segment of the gutter when the recess-engaging portion is inserted in the inward recess. The rear portion of the gutter guard extends spaced-apart from the bottom wall of the gutter even if unattached to the rear portion of the gutter.

In an embodiment, the central portion of the gutter guard extends at an angle ranging between about 0 degree and 45 degrees when the recess-engaging portion is inserted in the inward recess and the rear portion of the gutter guard is unattached to the rear portion of the gutter.

In an embodiment, the gutter guard is made of an aluminium-based sheet having a thickness ranging between about 0.3 mm and about 0.81 mm.

In an embodiment, the recess-engaging portion of the gutter guard extends next to a front end of the central portion of the gutter guard and the inclined segment abutting portion of the gutter guard extends between the recess-engaging portion of the gutter guard and a front free edge of the gutter guard.

In an embodiment, the inclined segment abutting portion of the gutter guard extends next to a front end of the central portion with the recess-engaging portion of the gutter guard extends between the inclined segment abutting portion and a front free edge of the gutter guard.

In an embodiment, the recess-engaging portion of the gutter guard comprises a plurality of folds to define a plurality of segments forming an upwardly and rearwardly extending hook having a tip abutting against an inner surface of the against the at least one of the upper rim and the downwardly forwardly-extending flange when inserted in the inward recess.

An angle ranging between about 35 degrees and about 80 degrees can be defined between the upper rim and the downwardly forwardly-extending flange.

An angle ranging between about 110 degrees and about 170 degrees can be defined between the upright substantial vertical segment and the outwardly inclined segment.

In an embodiment, the rear portion of the gutter guard comprises a rear wall and the central portion of the gutter guard comprises a plurality of through holes formed therein.

In an embodiment, the inclined segment abutting portion of the gutter guard abuts against the outwardly inclined segment of the gutter along an entire length of the inclined segment abutting portion of the gutter guard.

In an embodiment, the outwardly inclined segment of the gutter defines an angle ranging between about 10 degrees and about 85 degrees with a horizontal axis.

According to a further general aspect, there is provided a method for mounting a gutter assembly to a supporting surface. The method comprises: providing a gutter comprising a front portion, a rear portion having a rear wall, a bottom wall extending between the front portion and the rear portion, and an opening defined between the front and the rear portions adjacent to upper edges thereof, the front portion comprising an outwardly inclined segment and a front inverted hook member defining an inward recess; providing a gutter guard comprising a rear portion, and a central portion extending between the front portion and the rear portion, the front portion comprising a recess-engaging portion and an inclined segment abutting portion; engaging the recess-engaging portion in the inward recess to abut against the front inverted hook member with the inclined segment abutting portion abutting against the outwardly inclined segment of the gutter and the rear portion extending spaced-apart from the bottom wall of the gutter; inserting a lower segment of a drip edge between the rear wall of the gutter guard and the rear portion of the gutter; and securing an assembly including the rear wall of the gutter guard, the rear portion of the gutter, the lower segment of the drip edge together by inserting a plurality of longitudinally spaced-apart mechanical fasteners therein and into a supporting surface.

In an embodiment, the gutter guard is made of an aluminium-based sheet having a thickness ranging between about 0.3 mm and about 0.81 mm.

In an embodiment, the recess-engaging portion of the gutter guard comprises a plurality of folds to define a plurality of segments forming an upwardly and rearwardly extending hook having a tip abutting against an inner surface of the front inverted hook member when inserted in the inward recess.

In an embodiment, the inclined segment abutting portion of the gutter guard abuts against the outwardly inclined segment of the gutter along an entire length of the inclined segment abutting portion of the gutter guard.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

In the following description, there is described various embodiments related to a gutter guard and gutter assembly including a gutter guard. As will be readily understood by one skilled in the art, the gutter guard and gutter according to the embodiments presented herein and equivalents thereto may be provided separately or in combination. Such combination may or may not be commercialized as a kit to be assembled. In another embodiment, a gutter guard may be commercialized as a standalone component.

Although the embodiments of the gutter guard, the gutter and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the gutter guard, as will be briefly explained herein and as can be easily inferred herefrom by a person skilled in the art.

Moreover, it will be appreciated that positional descriptions such as "front", "rear", "upper", and the like should be taken in the context of the figures only and should not be considered as limiting. More particularly, they correspond to the position and orientation of the gutter, when mounted to a supporting surface of a supporting structure, and the gutter guard when mounted onto a gutter. The rear position corresponds to portions adjacent to the supporting surface while the front position corresponds to portions opposed to the supporting surface. The inner position corresponds to portions/surfaces facing the gutter trough while the outer position corresponds to portions/surfaces facing outwardly.

Having discussed the general context of the gutter guard, optional embodiments will be discussed further hereinbelow. The embodiments according to the following description are given for exemplification purposes only.

Figure 1:
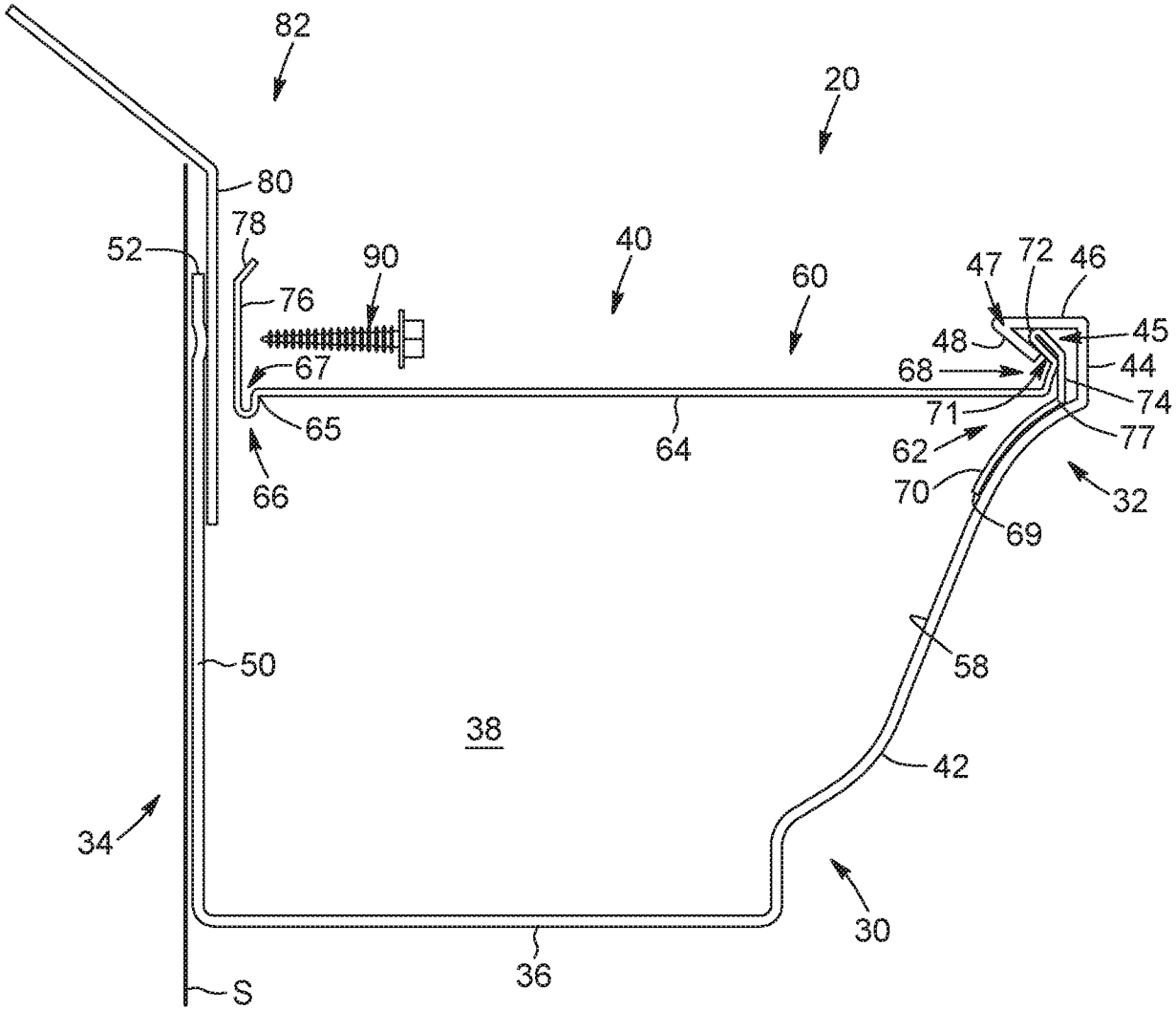
FIG. 1 illustrates a sectional view of a gutter guard engaged with a gutter according to an embodiment.

Referring now to FIG. 1, therein illustrated is a side elevation view of a gutter guard assembly 20 according to a first example embodiment. The gutter guard assembly 20 includes a gutter 30 and a gutter guard 60 engaged with the gutter 30. The gutter guard 60 includes a front portion 62, a central portion 64, and a rear portion 66. The front portion 62 is engageable with a front portion 32 of the gutter 30, as will be described in more details below. The rear portion 66 is configured in an adjacent configuration to a rear wall 50 of the gutter 30, as will be described in more details below. Furthermore, the central portion 64 of the gutter guard 60 extends between and connects the front portion 62 and the rear portion 66. The central portion 64 can include a plurality of through holes formed therein, such as being perforated. Furthermore, it can include one or more superposed layer, each one including through holes formed therein.

In the non-limitative embodiment shown, the gutter 30 includes a front portion 32, a rear portion 34, and a bottom wall 36 extending between the front portion 32 and the rear portion 34. Together, the front portion 32, the rear portion 34 and the bottom wall 36 define a trough 38 having an open top 40. The open top 40 of the gutter 30 may be defined between a top edge of the front portion 32 and a top edge of the rear portion 34 of the gutter 30. In the embodiment shown, the front portion 32 of the gutter 30 includes, successively from a front edge of the bottom wall 36, an outwardly inclined segment 42, an upright substantial vertical segment 44, an upper rim 46, extending essentially horizontally, and a downwardly forwardly-extending flange 48. The succession of the upright segment 44, the upper rim 46 and the downwardly forwardly-extending flange 48 define an inward recess 45. In turn, the upper rim 46 and the downwardly forwardly-extending flange 48 form a front inverted hook member 47 delimiting rearwardly the inward recess 45. It will be understood that the shape of the front portion 32 can vary from the embodiment described above with reference to FIG. 1.

In the embodiment shown, the upper rim 46 defines an upper edge of the gutter 30 in the front portion 32.

Since the outwardly inclined segment 42, which extends upwardly from the front edge of the bottom wall 36 is inclined forwardly, the through 38 is narrower adjacent to the bottom wall 36 and wider close to the open top 40.

In some implementations, the downwardly forwardly-extending flange 48 can include a downwardly-extending segment followed by a forwardly-extending segment, which can be substantially horizontal or inclined.

In an embodiment, the outwardly inclined segment 42 can extend at an angle defined between 10 and 85 degrees with a horizontal axis (or with the bottom wall 36 if the latter extends substantially horizontally) and, in another embodiment, between 50 and 85 degrees.

The outwardly inclined segment 42 (or any other segment) of the front portion 32 of the gutter 30 can be divided into a plurality of subsegments with a general profile corresponding to the profile shown in FIG. 1, i.e. inclined generally forwardly/outwardly for the outwardly inclined segment 42, extending generally upwardly for the upright substantial vertical segment 44, extending substantially horizontally for the upper rim 46, and extending generally downwardly and forwardly for the flange 48.

In the embodiment shown, the rear portion 34 of the gutter 30 includes essentially a rear wall 50 extending substantially vertically, i.e. normal to the bottom wall 36, and upwardly from a rear edge of the bottom wall 36. It includes an upper edge 52, which is free in the non-limitative embodiment shown. When the gutter 30 and/or the gutter assembly 20 is mounted to a supporting surface S, such as an outer surface of a building wall, the rear wall 50 is superposed to the supporting surface S. More particularly, a rear surface of the rear wall 50 contacts the supporting surface S.

Turning now to the gutter guard 60, in the illustrated embodiment, the front portion 62 of the gutter guard 60 is engaged with the front portion 32 of the gutter 30 and, more particularly, inserted in the inward recess 45 and having segments abutting against the front inverted hook member 47 and the outwardly inclined segment 42.

When the front portion 62 of the gutter guard 60 is engaged with the front portion 32 of the gutter 30, the gutter guard 60 is self-supporting, i.e. it will remain engaged with the front portion 32 of the gutter 30 and spaced-apart from the bottom wall 36 of the gutter 30. In some implementations, its central portion 64 will even extend substantially horizontally or at an angle $\alpha$ defined between about 0 and about 45 degrees with the horizontal axis (or with the bottom wall 36 if the latter extends substantially horizontally) due to gravity. In another embodiment, the angle $\alpha$ is defined between about 0 and about 30 degrees and, in still another another embodiment, the angle $\alpha$ is defined between about about 0 and about 20 degrees. Similarly, in some implementations, even when not attached to the rear wall 50 of the gutter 30, a rear wall 76 of the gutter guard 60 will extend substantially parallel to the rear wall 50 of the gutter 30 and, spaced-apart, from the bottom wall 36.

In a non-limitative embodiment, the gutter guard 60 is made of aluminium or an aluminium alloy. Its stiffness is sufficient to be self-supporting, as defined above. In an embodiment, the gutter guard 60 is made from an aluminium-based sheet having a thickness ranging between about 0.3 mm (12 mil (i.e. thousandth of an inch)) and about 0.81 mm (32 mil) and, in a particular embodiment, between about 0.4 mm (16 mil) and about 0.53 mm (21 mil). As it is known in the art, the folds formed in the aluminium-based sheet to define the different sections/segments of the gutter guard 60 increases its stiffness.

In the embodiment shown, the front portion 62 of the gutter guard 60 includes a recess-engaging portion 68 inserted in the inward recess 45 and an inclined segment abutting portion 70 abutting against the outwardly inclined segment 42 of the gutter 30. In the embodiment shown, the recess-engaging portion 68 extends next to a front end of the central portion 64 while the inclined segment abutting portion 70 extends between the recess-engaging portion 68 and a front free edge 69 of the gutter guard 60.

Figure 2:
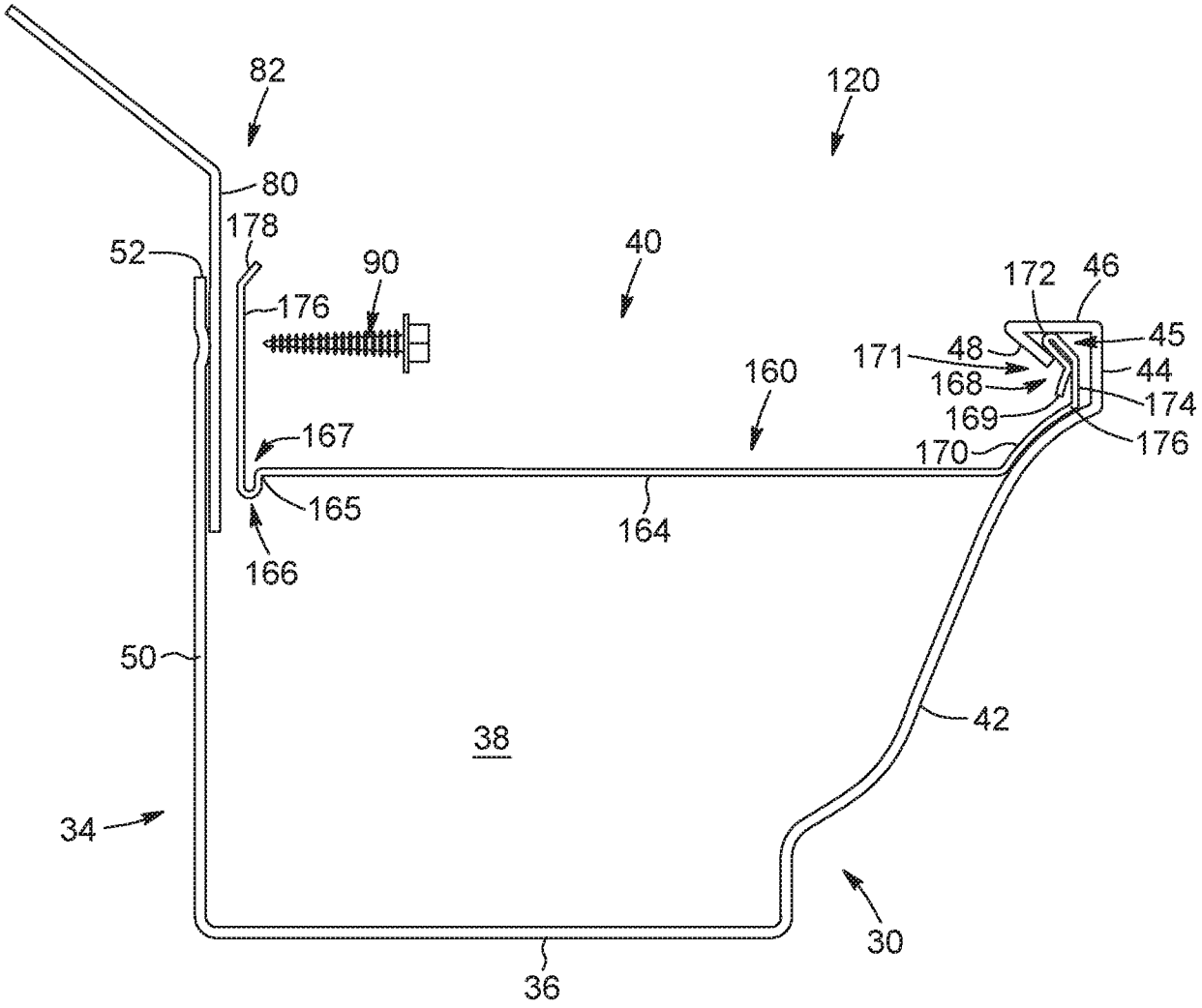
FIG. 2 is a sectional view of a gutter guard, according to another embodiment, engaged with the gutter of FIG. 1.

Referring to FIG. 2, there is shown an alternative embodiment of the gutter guard 160 wherein the features are numbered with reference numerals in the 100 series which correspond to the reference numerals of the previous embodiment. In this alternative embodiment, the inclined segment abutting portion 170 could extend next to the front end of the central portion 164 with the recess-engaging portion 168 extending between the inclined segment abutting portion 170 and the front free edge 169 of the gutter guard 160.

In the non-limitative embodiments shown, the recess-engaging portion 68, 168 comprises a plurality of folds to define a plurality of segments forming an upwardly and rearwardly extending hook (or front hook) 71, 171 having a tip 72, 172 abutting an inner surface of the front inverted hook member 47. The tip 72, 172 and other segments of the recess-engaging portion 68, 168 can abut against at least one of the upper rim 46 and the downwardly forwardly-extending flange 48.

Returning now to the embodiment of FIG. 1, the recess-engaging portion 68 ends with a substantially upright segment 74 directed towards the outwardly inclined segment 42 of the gutter 30. In the embodiment shown, a fold 77 separates the substantially upright segment 74 from the inclined segment abutting portion 70, which extends downwardly towards the front free edge 69 of the gutter guard 60 and rearwardly with respect to the substantially upright segment 74 and the upright substantial vertical segment 44. The inclined segment abutting portion 70 includes a single segment, i.e. no fold, in the non-limitative embodiment shown. However, it is appreciated that, in an alternative embodiment (not shown), it can include more than one segment separated from adjacent segment(s) by folds. As mentioned above, the inclined segment abutting portion 70 abuts at least partially against an inner surface 58 of the outwardly inclined segment 42 of the gutter 30, i.e. inside the gutter through 38. In the non-limitative embodiment shown, it abuts against the outwardly inclined segment 42 of the gutter 30 along its entire length (i.e. the length of the inclined segment abutting portion 70) and even at least partially conform to a shape (curvature) of the outwardly inclined segment 42 of the gutter 30.

It is appreciated that the shape and configuration of the recess-engaging portion 68 and the inclined segment abutting portion 70 can vary from the embodiment shown in FIG. 1.

As mentioned above, the rear portion 66 of the gutter guard 60 extends from a rear edge 65 of the central portion 64. In the non-limitative embodiment shown, it defines a shallow recess 67 between the rear edge 65 of the central portion 64 and the rear wall 76 of the gutter guard 60. The rear wall 76 extends upwardly with respect to the central portion 64 and substantially vertically. It is appreciated that, in an alternative embodiment (not shown), the rear portion 66 could be free of recess 67 extending longitudinally and between the central portion 64 and the rear wall 76 and the rear wall 76 could extend upwardly directly from a fold at the rear edge 65 of the central portion 64.

In the embodiment shown, the rear portion 66 of the gutter guard 60 further includes a forwardly and upwardly extending segment 78 extending from the rear wall 76. It is appreciated that, in an alternative embodiment (not shown), the rear portion 66 could be free of forwardly and upwardly extending segment 78.

As mentioned above, since the gutter guard 60 is self-supporting when its front portion 62 is engaged with the front portion 32 of the gutter 30, the rear wall 76 of the gutter guard 60 will extend substantially parallel to the rear wall 50 of the gutter 30 (or at a small angle defined inbetween due to gravity) even when the rear portion 66 of the gutter guard 60 is unfastened/unsecured/unengaged with the rear portion 34 of the gutter 30. In the embodiment shown, the rear wall 76 of the gutter guard 30 is slightly spaced-apart from the rear wall 50 of the gutter 30. However, it could contact the rear wall 50 and even be juxtaposed thereto.

In the embodiment wherein the gutter guard 60 includes the forwardly and upwardly extending segment 78, this segment can be spaced-apart from the rear wall 50 of the gutter 30.

In the non-limitative embodiment shown, a lower segment 80 of a drip edge 82, i.e. a metal flashing that is installed at the edges of a roof to help control the flow of water away from the fascia and to protect the underlying roofing components, can be inserted between the rear wall 76 of the gutter guard 30 and the rear wall 50 of the gutter 30 and secured together with the gutter assembly 20 with mechanical fasteners, as will be described in more details below. It is appreciated that inserting the lower segment 80 of the drip edge 82 into the gutter trough 38 helps controlling the water flow by directing water from the drip edge 82, away from the fascia, and into the gutter trough 38.

It is appreciated that the rear portion 66 of the gutter guard 60 can be secured to the rear portion 34 of the gutter 30 and the supporting surface S using mechanical fasteners 90, such as and without being limitative screws, spikes, and/or ferrules, inserted into the rear wall 76 of the gutter guard 60, the lower segment 80 of the drip edge 82, if any, the rear wall 50 of the gutter 30, and the supporting surface S. When assembled, at least at their front portions 32, 62, the gutter 30 and the gutter guard 60 forms the gutter assembly 20.

It is appreciated that the gutter 30 can be an already-mounted gutter, i.e. a gutter mounted to the supporting surface S using other mechanical fasteners (i.e. mechanical fasteners not engaged with the gutter guard 60) or a newly-mounted gutter, wherein the gutter 30 is mounted simultaneously with the gutter guard 60 to the supporting surface S using the mechanical fasteners 90. If the gutter 30 is an already-mounted gutter, it can include a plurality of traditional hangers (not shown) extending between and connecting together the front portion 32 and the rear portion 34 to maintain the spacing between the front portion 32 and the rear portion 34 of the gutter 30. As it is known in the art, the hangers extend in an upper portion of the gutter 30, spaced-apart from the bottom wall 36. In such embodiment, the gutter guard 60 is located above the hangers.

If the gutter 30 is a newly-mounted gutter, the gutter guard 60 acts as a continuous hanger by extending between and connecting together the front portion 32 and the rear portion 34 to maintain the spacing between the front portion 32 and the rear portion 34 of the gutter 30.

The self-supporting feature of the gutter guard 60, i.e. the engagement between the front portion 62 of the gutter guard 60 with the front portion 32 of the gutter 30, may ease the installation of the gutter 30 and the gutter guard 60 by preventing the gutter guard 60 to fall into the gutter trough 38 during installation and before engagement of the rear portion 66 of the gutter guard 60 with the rear portion 34 of the gutter 30.

Thus, the front portion 62 of the gutter guard 60 can be first engaged with the front portion 32 of the gutter 30, which can be either already mounted to the supporting surface S or not. As mentioned above, engagement of the front portion 62 of the gutter guard with the front portion 32 of the gutter 30 includes inserting the recess-engaging portion 68 of the gutter guard 60 in the inward recess 45 of the gutter 30 with the inclined segment abutting portion 70 of the gutter guard 60 abutting and resting against the outwardly inclined segment 42 of the gutter 30.

Once engaged in the front portions 32, 62, the gutter guard 60 is self-supporting with respect to the gutter 30. Then, if the gutter 30 is not already mounted to the supporting surface S, it can be superposed to the supporting surface S in a desired configuration wherein a rear surface of the rear wall 50 abuts against the supporting surface S. If desired, the lower segment 80 of the drip edge 82 can be inserted between the rear wall 76 of the gutter guard 60 and the rear wall 50 of the gutter 30, at least along a section thereof. Then, the rear portion 66 of the gutter guard 60 can be secured to the rear portion 34 of the gutter 30 using a plurality of spaced-apart mechanical fasteners 90 as detailed above. If the gutter 30 is not already mounted to the supporting surface S, insertion of the mechanical fasteners 90 simultaneously mount the gutter 30 to the supporting surface S.

Features and characteristics of the embodiment shown in FIG. 2 with respect to the rear portion 166 and the method for mounting the gutter assembly 120 to a support structure are similar to the one described above in reference to FIG. 1.

Figure 4:
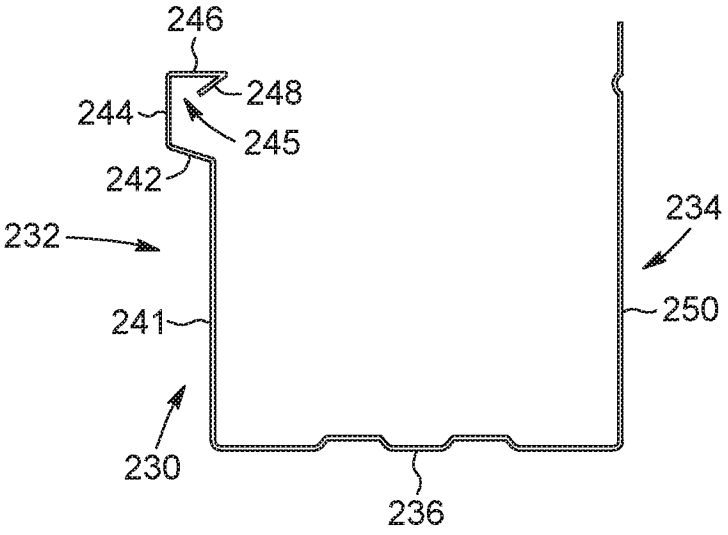
FIGS. 3 and 4 are respectively perspective and sectional views of a gutter in accordance with another embodiment.
Figure 3:
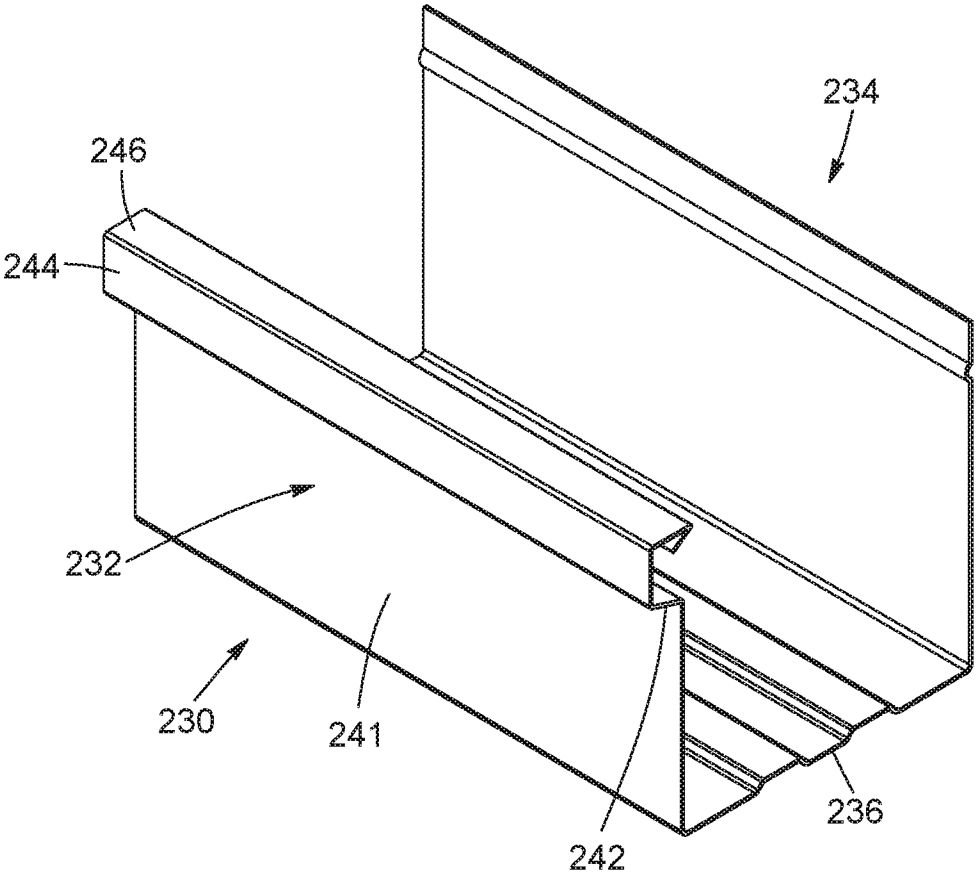

Referring now to FIGS. 3 and 4, there is shown an alternative embodiment of a gutter 230 which can be engaged by one of the gutter guards 60, 160 or any alternative embodiment thereof. The features of the gutter 230 are numbered with reference numerals in the 200 series which correspond to the reference numerals of the previous embodiments. In this alternative embodiment, the front portion 232 of the gutter 230 includes, successively from a front edge of the bottom wall 236, a first (lower) upright substantial vertical segment 241, an outwardly inclined segment 242, a second (upper) upright substantial vertical segment 244, an upper rim 246 (defining an upper edge of the gutter 230 in the front portion 232), extending essentially horizontally, and a downwardly forwardly-extending flange 248. The succession of the second (upper) upright substantial vertical segment 244, the upper rim 246 and the downwardly forwardly-extending flange 248 define the inward recess 245. When engaged with a gutter guard 60,160, the inclined segment abutting portion 70, 170 of the gutter guard abuts against the outwardly inclined segment 242 of the gutter 230 with the recess-engaging portion 68, 168 of the gutter guard 60, 160 being inserted in the inward recess 245 of the gutter 230.

When the front portion 62, 162 of the gutter guard 60, 160 is engaged with the front portion 232 of the gutter 230, the gutter guard 60, 160 is self-supporting, i.e. it will remain engaged with the front portion 232 of the gutter 230 and spaced-apart from the bottom wall 236 of the gutter 230, even when the rear portion 66, 166 of the gutter guard 60, 160 is unfastened/unsecured/unengaged with the rear portion 234 of the gutter 230.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A gutter assembly securable to a supporting structure, the gutter assembly comprising:

a gutter having a front portion, a rear portion, a bottom wall extending between the front portion and the rear portion, and an opening defined between the front and the rear portions adjacent to upper edges thereof, the front portion comprising an outwardly inclined segment, an upper rim, and a downwardly forwardly-extending flange, the upper rim and the downwardly forwardly-extending flange forming a front inverted hook member defining an inward recess; and a gutter guard engageable with the gutter to cover the opening, the gutter guard being formed of a single sheet folded to define a front portion operatively engageable with the front portion of the gutter, a rear portion operatively engageable with at least one of the rear portion of the gutter and the supporting structure, and a central portion extending between the front portion and the rear portion, having a plurality of through holes formed therein, and covering a majority of the opening and extending spaced-apart from the bottom wall of the gutter when the front portion of the gutter guard is engaged with the front portion of the gutter, the front portion comprising a recess-engaging portion and an inclined segment abutting portion, the recess-engaging portion being insertable in the inward recess of the gutter in abutment against the front inverted hook member and the inclined segment abutting portion abutting against the outwardly inclined segment of the gutter and extending at least partially under the downwardly forwardly-extending flange of the front portion of the gutter when the front portions of the gutter and the gutter guard are engaged together, wherein the central portion of the gutter guard remains at an angle ranging between about 0 degree and 30 degrees, with an horizontal axis, when front portions of the gutter and the gutter guard are engaged together even if the rear portion of the gutter guard is unsupported.

2. The gutter assembly as claimed in claim 1, wherein the central portion of the gutter guard extends at an angle ranging between about 0 degree and 20 degrees with the horizontal axis and below the upper edges of the front and the rear portions of the gutter when the recess-engaging portion is inserted in the inward recess and the rear portion of the gutter guard is not engaged with the rear portion of the gutter.

3. The gutter assembly as claimed in claim 1, wherein the gutter guard is made of an aluminium-based sheet having a thickness ranging between about 0.3 mm and about 0.81 mm.

4. The gutter assembly as claimed in claim 1, wherein the recess-engaging portion of the gutter guard extends next to a front end of the central portion of the gutter guard and the inclined segment abutting portion of the gutter guard extends between the recess-engaging portion of the gutter guard and a front free edge of the gutter guard.

5. The gutter assembly as claimed in claim 1, wherein the inclined segment abutting portion of the gutter guard extends next to a front end of the central portion with the recess-engaging portion of the gutter guard extends between the inclined segment abutting portion and a front free edge of the gutter guard.

6. The gutter assembly as claimed in claim 1, wherein the recess-engaging portion of the gutter guard comprises a plurality of folds to define a plurality of segments forming an upwardly and rearwardly extending hook having a tip abutting against an inner surface of the front inverted hook member when inserted in the inward recess.

7. The gutter assembly as claimed in claim 6, wherein the front portion of the gutter comprises successively, from a front edge of the bottom wall, the outwardly inclined segment, an upright substantial vertical segment, the upper rim, extending essentially horizontally, and the downwardly forwardly-extending flange, with the upper rim and the downwardly forwardly-extending flange, wherein an angle ranging between about 35 degrees and about 80 degrees is defined between the upper rim and the downwardly forwardly-extending flange and an angle ranging between about 110 degrees and about 170 degrees is defined between the upright substantial vertical segment and the outwardly inclined segment.

8. The gutter assembly as claimed in claim 7, wherein the tip abuts against at least one of the upper rim and the downwardly forwardly-extending flange when inserted in the inward recess.

9. The gutter assembly as claimed in claim 1, wherein the inclined segment abutting portion of the gutter guard extends under a section of the central portion of the gutter guard and abuts against the outwardly inclined segment of the gutter along an entire length of the inclined segment abutting portion of the gutter guard.

10. The gutter assembly as claimed in claim 1, wherein the outwardly inclined segment of the gutter defines an angle ranging between about 10 degrees and about 85 degrees with a horizontal axis and extends rearwardly at least past a junction between the upper rim and the downwardly forwardly-extending flange of the gutter.

11. The gutter assembly as claimed in claim 1, wherein the central portion of the gutter guard extends substantially horizontally when the recess-engaging portion is inserted in the inward recess and the rear portion of the gutter guard is unsupported.

12. The gutter assembly as claimed in claim 1, wherein the rear portion of the gutter guard extends substantially perpendicular to the central portion of the gutter guard and substantially parallel to the rear portion of the gutter when the recess-engaging portion is inserted in the inward recess and the rear portion of the gutter guard is unsupported.

13. A gutter assembly securable to a supporting structure, the gutter assembly comprising:

a gutter having a front portion, a rear portion, a bottom wall extending between the front portion and the rear portion, and an opening defined between the front and the rear portions adjacent to upper edges thereof, the front portion comprising an outwardly inclined segment, an upright segment, an upper rim, and a downwardly forwardly-extending flange, wherein the upright segment, the upper rim, and the downwardly forwardly-extending flange define an inward recess; and a gutter guard engageable with the gutter to cover the opening, the gutter guard being formed of a single sheet folded to define a front portion operatively engageable with the front portion of the gutter, a rear portion operatively engageable with at least one of the rear portion of the gutter and the supporting structure, and a central portion extending between the front portion and the rear portion with folds separating the central portion respectively from the front and the rear portions of the gutter guard, the central portion including a plurality of through holes formed therein, the rear portion including at least one segment extending substantially parallel to the rear wall of the gutter when engaged therewith, the front portion comprising a recess-engaging portion and an inclined segment abutting portion, the central portion extending along a plane substantially parallel to the bottom wall of the gutter when the front and the rear portions of the gutter guard and the gutter are engaged together, wherein the central portion of the gutter guard remains at an angle ranging between about 0 degree and 30 degrees, with an horizontal axis, when the recess-engaging portion is inserted in the inward recess and abutted against at least one of the upper rim and the downwardly forwardly-extending flange with the inclined segment abutting portion abutting against the outwardly inclined segment of the gutter and extending at least partially under the downwardly forwardly-extending flange of the front portion of the gutter, even if the rear portion of the gutter guard is not engaged with at least one of the rear portion of the gutter and the supporting structure.

14. The gutter assembly as claimed in claim 13, wherein the central portion of the gutter guard extends at an angle ranging between about 0 degree and 20 degrees with the horizontal axis and below the upper edges of the front and the rear portions of the gutter when the recess-engaging portion is inserted in the inward recess and the rear portion of the gutter guard is not engaged with the rear portion of the gutter.

15. The gutter assembly as claimed in claim 13, wherein the gutter guard is made of an aluminium-based sheet having a thickness ranging between about 0.3 mm and about 0.81 mm.

16. The gutter assembly as claimed in claim 13, wherein the recess-engaging portion of the gutter guard extends next to a front end of the central portion of the gutter guard and the inclined segment abutting portion of the gutter guard extends between the recess-engaging portion of the gutter guard and a front free edge of the gutter guard.

17. The gutter assembly as claimed in claim 13, wherein the inclined segment abutting portion of the gutter guard extends next to a front end of the central portion with the recess-engaging portion of the gutter guard extends between the inclined segment abutting portion and a front free edge of the gutter guard.

18. The gutter assembly as claimed in claim 17, wherein an angle ranging between about 35 degrees and about 80 degrees is defined between the upper rim and the downwardly forwardly-extending flange, an angle ranging between about 110 degrees and about 170 degrees is defined between the upright substantial vertical segment and the outwardly inclined segment, and the outwardly inclined segment of the gutter defines an angle ranging between about 10 degrees and about 85 degrees with a horizontal axis and extends rearwardly at least past a junction between the upper rim and the downwardly forwardly-extending flange of the gutter.

19. The gutter assembly as claimed in claim 13, wherein the recess-engaging portion of the gutter guard comprises a plurality of folds to define a plurality of segments forming an upwardly and rearwardly extending hook having a tip abutting against an inner surface of at least one of the upper rim and the downwardly forwardly-extending flange when inserted in the inward recess.

20. The gutter assembly as claimed in claim 13, wherein the inclined segment abutting portion of the gutter guard extends under a section of the central portion of the gutter guard and abuts against the outwardly inclined segment of the gutter along an entire length of the inclined segment abutting portion of the gutter guard.

21. The gutter assembly as claimed in claim 13, wherein the central portion of the gutter guard extends substantially horizontally when the recess-engaging portion is inserted in the inward recess and the rear portion of the gutter guard is unsupported.

22. The gutter assembly as claimed in claim 13, wherein the rear portion of the gutter guard extends substantially perpendicular to the central portion of the gutter guard and substantially parallel to the rear portion of the gutter when the recess-engaging portion is inserted in the inward recess and the rear portion of the gutter guard is not engaged with the rear portion of the gutter.

* * * * *